US006745777B2

(12) United States Patent
Liu

(10) Patent No.: US 6,745,777 B2
(45) Date of Patent: Jun. 8, 2004

(54) TOBACCO FILTER MEANS SUPERIMPOSEDLY RECHARGEABLY FILLED WITH DISPOSABLE FILTER UNITS

(76) Inventor: Te-San Liu, No. 7, Industrial First Road, Ping-tung City (TW)

( * ) Notice: Subject to any disclaimer, the term of this patent is extended or adjusted under 35 U.S.C. 154(b) by 0 days.

(21) Appl. No.: 10/280,845

(22) Filed: Oct. 24, 2002

(65) Prior Publication Data

US 2003/0079755 A1 May 1, 2003

(30) Foreign Application Priority Data

Oct. 25, 2001 (CN) ..... 01132002 A

(51) Int. Cl.[7] ..... A24F 7/02; A24D 3/04

(52) U.S. Cl. ..... 131/225; 131/226; 131/227; 131/187; 131/200; 131/341; 131/344

(58) Field of Search ..... 131/225, 226, 131/227, 187, 200, 341, 344

(56) References Cited

U.S. PATENT DOCUMENTS 3,662,764 A * 5/1972 Blanco ..... 131/207
5,540,241 A * 7/1996 Kim ..... 131/215.2
2003/0140933 A1 * 7/2003 Eichel ..... 131/334

* cited by examiner

*Primary Examiner*—Dionne A. Walls

(57) ABSTRACT

A tobacco filter device includes a plurality of filter units superimposedly rechargeably filled in a sleeve member, having a bowl member connected to an outer end (smoking end) of the sleeve member and a mouthpiece connected to an inner end (mouth end) of the sleeve member, whereby upon smoking of tobacco or a cigarette as loaded or inserted in the bowl portion, the filter unit or units positioned on an outer portion of the sleeve member adjacent to the smoking end, after being saturated with smoking waste including tar and nicotine, may be pushed outwardly and discarded from the outer end of the sleeve member as thrusted and urged by a fresh (new) filter unit (or units) as recharged into the inner (mouth) end of the sleeve member, thereby still keeping use of those filter units not yet saturated and loaded in the rear portion of the sleeve member, without wasting the useful filter units.

10 Claims, 5 Drawing Sheets

TOBACCO FILTER MEANS SUPERIMPOSEDLY RECHARGEABLY FILLED WITH DISPOSABLE FILTER UNITS

BACKGROUND OF THE INVENTION

A conventional filter device may be used to insert a cigarette therein for filtering off nicotine or tar of tobacco smoke. However, the tar or smoke waste may easily clog the front portion of the filter device to influence a smooth cigarette smoking. Even the filter device may still be used since the filter material as filled in the filter device is not completely saturated, the smoker may discard the partially saturated filter device just simply because of unsmooth smoking through the partially clogged filter to thereby cause wasting of the filter device.

The present inventor has found the drawbacks of conventional cigarette filter device and invented the present filter device having a plurality of filter units superimposedly rechargeably filled therein.

SUMMARY OF THE INVENTION

The object of the present invention is to provide a tobacco filter device including a plurality of filter units superimposedly rechargeably filled in a sleeve member, having a bowl member connected to an outer end (smoking end) of the sleeve member and a mouthpiece connected to an inner end (mouth end) of the sleeve member, whereby upon smoking of tobacco or a cigarette as loaded or inserted in the bowl portion, the filter unit or units positioned on an outer portion of the sleeve member adjacent to the smoking end, after being saturated with smoking waste including tar and nicotine, may be pushed outwardly and discarded from the outer end of the sleeve member as thrusted and urged by a fresh (new) filter unit (or units) as recharged into the inner (mouth) end of the sleeve member, thereby still keeping use of those filter units not yet saturated and loaded in the rear portion of the sleeve member, without wasting the useful filter units.

DETAILED DESCRIPTION

Figure 1:
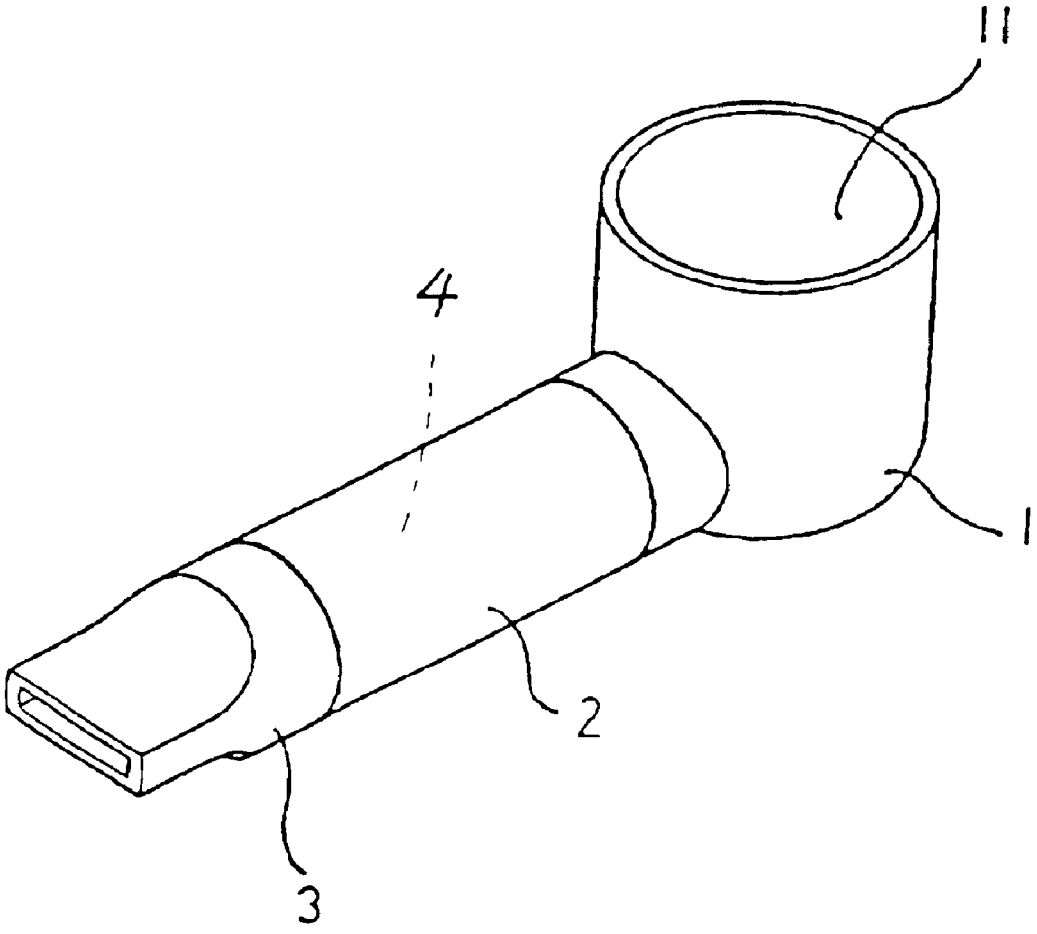
FIG. 1 is a perspective drawing of the present invention.
Figure 2:
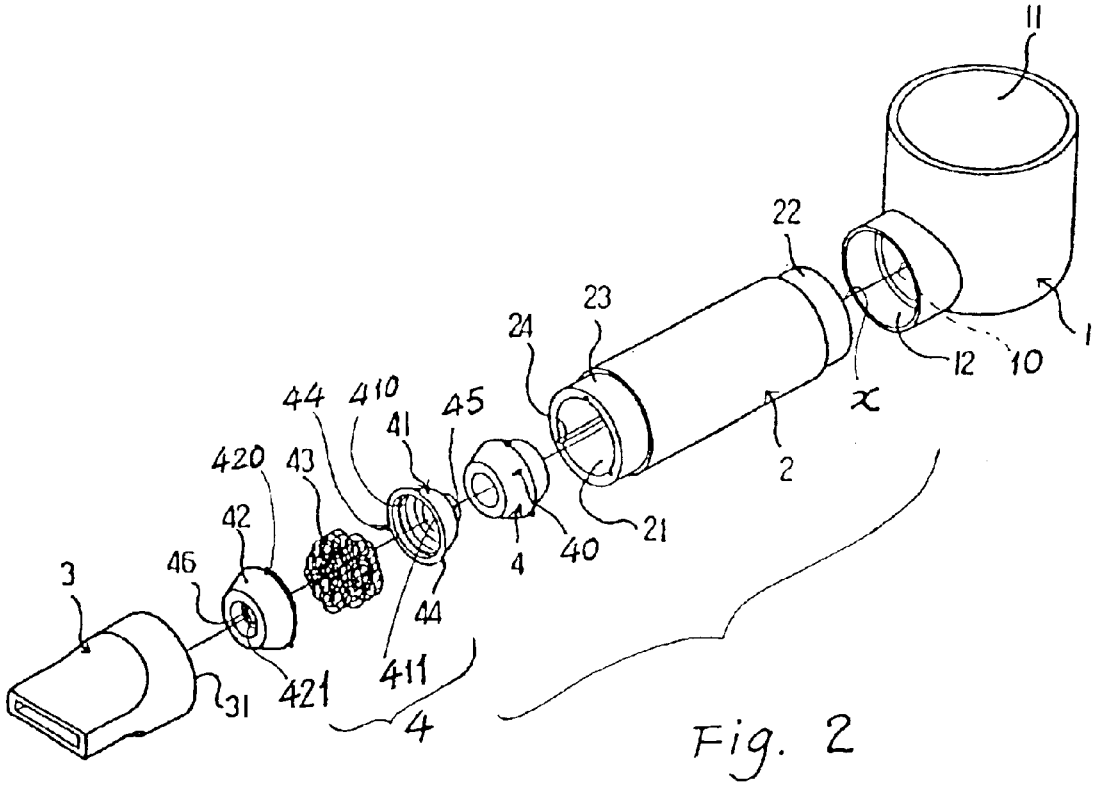
FIG. 2 is an exploded view showing the elements of the present invention.
Figure 3:
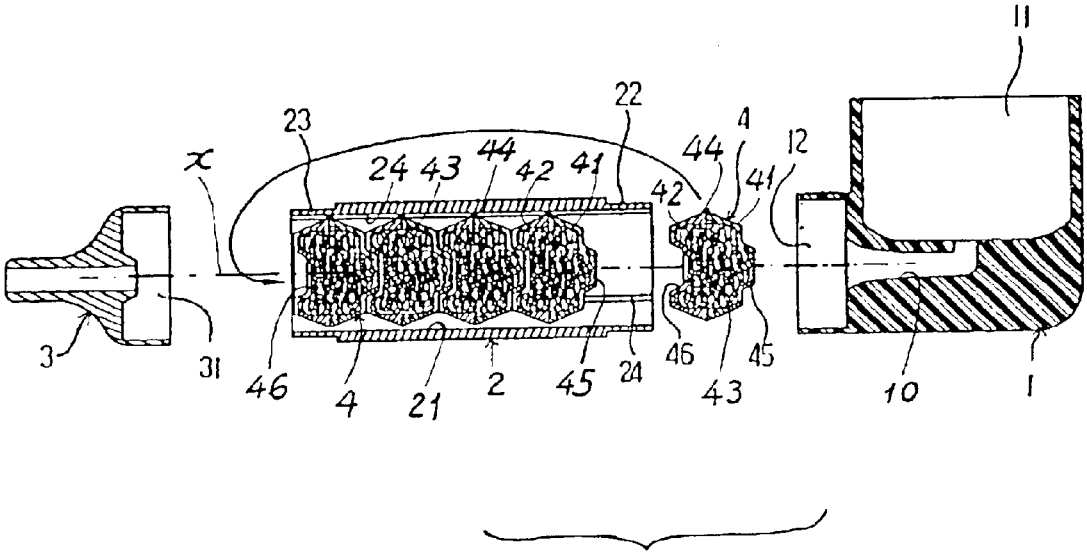
FIG. 3 is a sectional drawing of the present invention.
Figure 4:
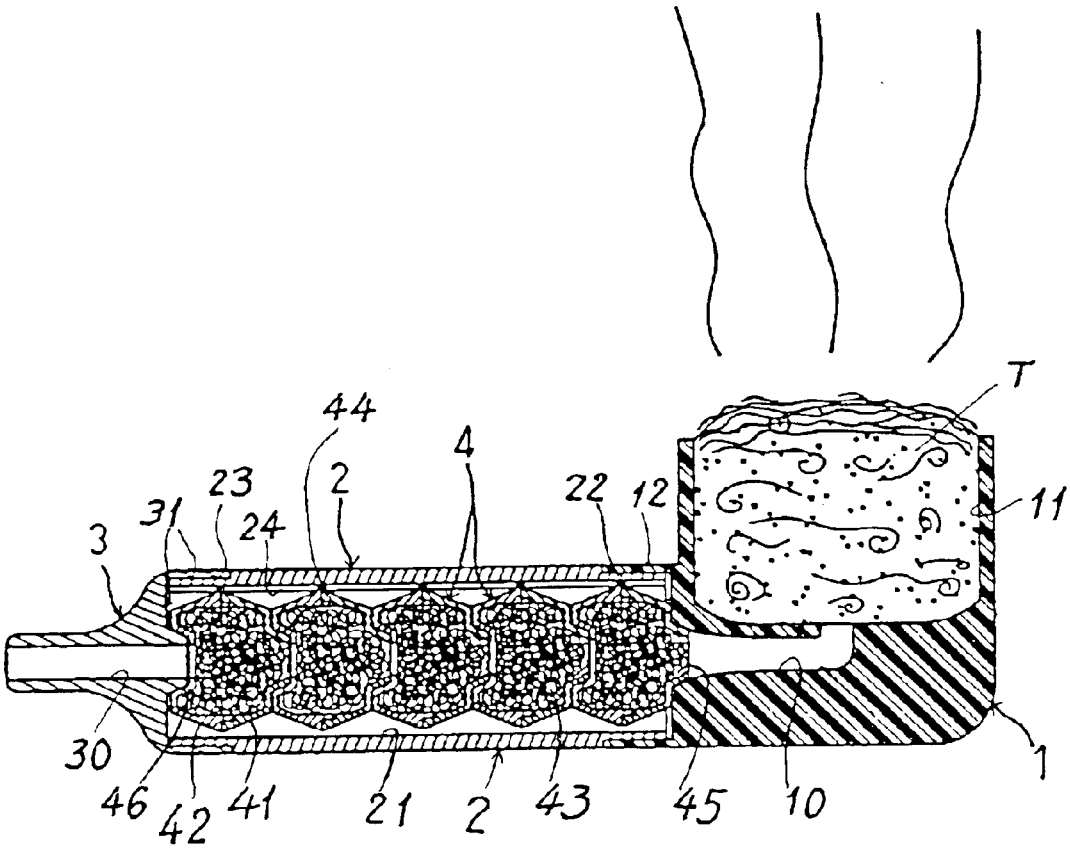
FIG. 4 is a sectional drawing of the present invention as assembled from FIG. 3.

A tobacco filter means of the present invention comprises: a sleeve member 2; having a plurality of filter units 4, each having filter material 43 absorbing or adsorbing smoke waste materials including nicotine, tar and other smoking residue, superimposedly rechargeably filled in a central hole 21 formed through the sleeve member 2; having an outer end portion of the sleeve member 2 adapted for filling tobacco T therein or for inserting a cigarette C therein; and having an inner end portion of the sleeve member adapted to be received into or sucked by a smoker's mouth.

After smoking for a time period, the filter unit (or units) loaded on a front or outer portion of the sleeve member 2 may be saturated or clogged by the smoke waste, a new or fresh filter unit may be recharged or refilled into the sleeve member 2 through the inner end portion of the sleeve member for thrusting the filter units forwardly to outwardly discard the filter unit (units) as saturated or clogged at the front end portion of the sleeve member 2. Therefore, only the saturated or clogged outer filter units are discarded, the remaining filter units 4 may still be used, to thereby save filter units 4 and save money for the cigarette or tobacco smoker. It is also beneficial for environmental protection since waste disposal problem of used filter units can then be improved.

The sleeve member 2 includes: an outer adapter 22 connected with a bowl member 1 for filling tobacco or inserting a cigarette in the bowl member 1; and an inner adapter 23 of the sleeve member 2 connected with a mouthpiece 3 as received by a smoker's mouth.

The bowl member 1 includes a recess 11 for filling tobacco T therein, and an outer connector 12 fluidically communicated with the recess 11 through a gas passage 10 formed in the bowl member 1 and coupled to the outer adapter 22 of the sleeve member 2.

The mouthpiece 3 includes an inner connector 31 coupled with and fluidically communicated with the inner adapter 23 of the sleeve member 2; with the mouthpiece 3 detachably coupled to the inner adapter 23 of the sleeve member 2 for refilling new filter unit 4 into the sleeve member 2.

Figure 5:
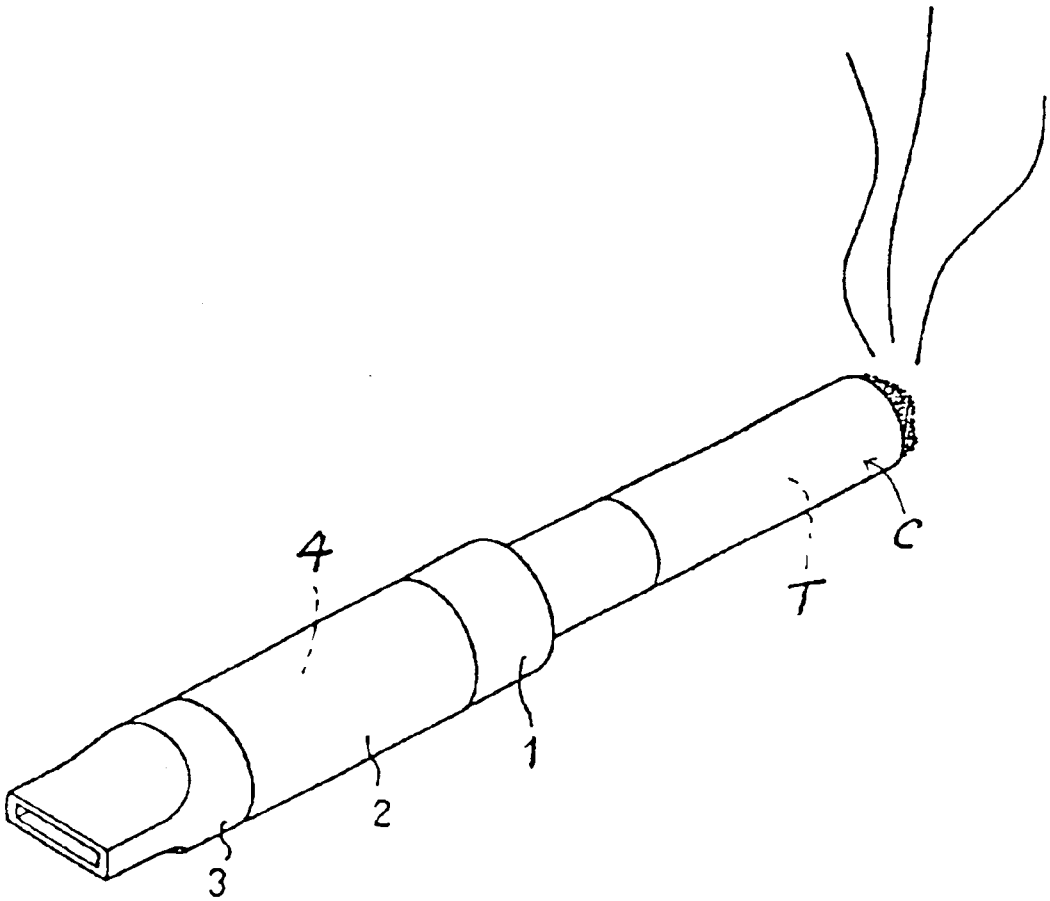
FIG. 5 is a perspective view of another preferred embodiment of the present invention.

The bowl member 1 as shown in FIGS. 1~4 is provided for smoking tobacco as a pipe smoker. Or, the bowl member 1 may be simplified to be a short cylinder as shown in FIG. 5 to be inserted therein a paper cigarette C.

The filter unit 4 includes the filter material 43 which is formed with fibrous materials added with activated carbon or additives (such as menthol) therein, capable for absorbing or adsorbing nicotine, tar, or other combustion wastes after smoking.

If provided for personal favorite, a special additive such as perfume or menthol may be added into those filter units 4 having marking 40 such as color or figure marking indicating the specific additive incorporated into the filter materials in the filter units 4, therefore the smoker may fill his or her personal favorite filter units having their preferred additives contained in the filter units for enriching the interesting choices of the present invention.

For preventing a free rotation of each filter unit 4 and ensuring a smooth movement within the sleeve member 2, each filter unit 4 is formed with at least a lug 44 on a perimeter of the filter unit 4, with the lug 44 slidably engageable with at least a longitudinal groove 24 longitudinally recessed in an inside wall of the sleeve member 2 and parallel to a longitudinal axis X of the sleeve member 2.

Each filter unit 4 includes a plug portion 45 protruding forwardly from a front end of the filter unit 4 and a socket portion 46 recessed in a rear end portion of the filter unit 4 so that a rear filter unit may be engaged with a front filter unit by engaging one's plug portion 45 with the other's socket portion 46.

Each filter unit 4 includes: a male cover 41 having the plug portion 45 formed on a front portion of the male cover 41, a front central hole 411 formed through the male cover 41 and a first connecting portion or a female-threaded portion 410 formed in a rear portion of the male cover 41; and a female cover 42 having the female socket 46 formed on a rear portion of the female cover 42 and engageable with the plug portion 45 for coupling a front filter unit with a rear filter unit by engaging the plug portion 45 of the rear filter unit with the female socket 46 of the front filter unit, a rear central hole 421 formed through the female cover 42, and a second connecting portion or a male-threaded portion 420 formed on a front portion of the female cover 42 to be engaged with the first connecting portion or female-threaded portion 410 formed on the male cover 41 so that the male cover 41 can be combined with the female cover 42 to incorporate the filter material 43 in the front and rear central holes 411, 421 between the male and female covers 41, 42.

The male cover 41 and the female cover 42 may be coupled or combined by any other joining methods including adhesive bonding, not limited in the present invention.

Each filter unit 4 may also be integrally formed by forming the filter material 43 integrally with the male cover 41 and the female cover 42 to be an integrated "porous ball" or "porous disk", of which a plurality of the porous balls (or disks) may be superimposed longitudinally lengthywise through the sleeve member 2.

After filling all the filter units 4 in the sleeve (or tube) member 2, the mouthpiece 3 and the bowl member 1 disposed on opposite ends of the sleeve member 2 will serve as stoppers for limiting the filter units 4 within the sleeve member 2 in between the mouthpiece 3 and the bowl member 1.

For removing or discarding the clogged filter unit(s) 4 at the front end of the sleeve member 2, the bowl member 1 may be detached from the sleeve member for discharging the used filter unit and a new filter unit is refilled into the sleeve member 2 by dismantling the mouthpiece 3 from the sleeve member 2.

So, the present invention provides a cigarette or tobacco filter device for economically saving filter units 4 and for better environmental protection. The present invention may be modified without departing from the spirit and scope of the present invention.

I claim:

1. A tobacco filter means comprises: a sleeve member including a plurality of filter units, having filter material formed in each said filter unit for absorbing or adsorbing smoke waste materials, superimposedly rechargeably filled in a central hole formed through the sleeve member; each said filter unit formed with at least a lug on a perimeter of the filter unit, with the lug slidably engageable with at least a longitudinal groove longitudinally recessed in an inside wall of the sleeve member and parallel to a longitudinal axis of the sleeve member; having an outer end portion of the sleeve member adapted for filling tobacco therein or for inserting a cigarette therein; and having an inner end portion of the sleeve member adapted to be received into or sucked by a smoker's mouth; whereby upon smoking for a time period and when the filter unit loaded on an outer portion of the sleeve member is saturated or clogged by the smoke waste, a new filter unit is recharged into the sleeve member through the inner end portion of the sleeve member for thrusting the filter units forwardly to outwardly discard the filter unit as saturated or clogged through a front end portion of the sleeve member.

2. A tobacco filter means according to claim 1, wherein said sleeve member includes: an outer adapter connected with a bowl member for filling tobacco or inserting a cigarette in the bowl member; and an inner adapter of the sleeve member connected with a mouthpiece as received by a smoker's mouth.

3. A tobacco filter means according to claim 2, wherein said bowl member includes a recess for filling tobacco therein, and an outer connector fluidically communicated with the recess through a gas passage formed in the bowl member and coupled to the outer adapter of the sleeve member.

4. A tobacco filter means according to claim 2, wherein said mouthpiece includes an inner connector coupled with and fluidically communicated with the inner adapter of the sleeve member; with the mouthpiece detachably coupled to the inner adapter of the sleeve member for refilling new filter unit into the sleeve member.

5. A tobacco filter means according to claim 2, wherein said bowl member is formed as a short cylinder for inserting a paper cigarette therein.

6. A tobacco filter means according to claim 1, wherein said filter unit includes the filter material which is formed with fibrous materials added with smoker's personal favorite additives therein.

7. A tobacco filter means according to claim 1, wherein each said filter unit includes a plug portion protruding forwardly from a front end of the filter unit and a socket portion recessed in a rear end portion of the filter unit so that a rear filter unit may be engaged with a front filter unit by engaging the plug portion of a filter unit with the socket portion of the other filter unit.

8. A tobacco filter means according to claim 7, wherein each said filter unit includes: a male cover having the plug portion formed on a front portion of the male cover, a front central hole formed through the male cover and a first connecting portion formed in a rear portion of the male cover; and a female cover having the female socket formed on a rear portion of the female cover and engageable with the plug portion for coupling a front filter unit with a rear filter unit by engaging the plug portion of the rear filter unit with the female socket of the front filter unit, a rear central hole formed through the female cover, and a second connecting portion formed on a front portion of the female cover to be engaged with the first connecting portion formed on the male cover so that the male cover can be combined with the female cover to incorporate a filter material in the front and rear central holes between the male and female covers.

9. A tobacco filter means according to claim 8, wherein each said filter unit is integrally formed by forming the filter material integrally with the male cover and the female cover to be an integrated porous piece, of which a plurality of the porous pieces are superimposed longitudinally lengthywise through the sleeve member.

10. A tobacco filter means according to claim 1, wherein the filter units as filled in the sleeve member are limited by a mouthpiece and a bowl member disposed on opposite ends of the sleeve member.

* * * * *